US006414676B1

(12) United States Patent
Boigues

(10) Patent No.: US 6,414,676 B1
(45) Date of Patent: Jul. 2, 2002

(54) SYSTEM FOR CONTROLLING A LIQUID-CRYSTAL DISPLAY SCREEN

(75) Inventor: Norbert Boigues, Rambouillet (FR)

(73) Assignee: Mannesmann VDO AG, Frankfurt am Main (DE)

( * ) Notice: Subject to any disclaimer, the term of this patent is extended or adjusted under 35 U.S.C. 154(b) by 0 days.

(21) Appl. No.: 09/322,439

(22) Filed: May 28, 1999

(30) Foreign Application Priority Data

May 29, 1998 (FR) ..... 98 06828

(51) Int. Cl.[7] ..... G09G 5/00
(52) U.S. Cl. ..... 345/213; 345/214; 345/99
(58) Field of Search ..... 345/63, 88, 77, 345/213, 214, 153, 428, 98; 348/673, 537

(56) References Cited

U.S. PATENT DOCUMENTS 4,780,759 A * 10/1988 Matsushima et al. ..... 348/537
5,541,646 A 7/1996 Huang
5,703,661 A * 12/1997 Wu ..... 348/673
5,721,570 A * 2/1998 Tsunoda et al. ..... 345/213
5,726,677 A 3/1998 Imamura
6,078,317 A * 6/2000 Sawada ..... 345/204

FOREIGN PATENT DOCUMENTS

EP 0291252 11/1988

* cited by examiner

*Primary Examiner*—Steven Saras
*Assistant Examiner*—Uchendu O. Anyaso
(74) *Attorney, Agent, or Firm*—Mayer, Brown, Rowe & Maw

(57) ABSTRACT

A video signal generator comprises a frequency divider (5), connected to the pixel oscillator (4) to deliver a width-modulated control signal (Ftr) at a lower frequency than, but synchronized with, the pixel signal. A local pixel synchronizing signal generator (14) includes a PLL-loop provided, in succession, with a first division stage (10) and with a second division stage (11) which bring the pixel frequency (fpx) down to the line frequency (ftr). Between the first division stage (10) and the second division stage, the signal is fed into a divider (12) whose output is connected to the clock input (Cp) of a D-type flip-flop, the input D of which is connected to the control signal (Ftr) and the output (Q) of which delivers a signal (Fpwm) for adjusting the screen.

12 Claims, 1 Drawing Sheet

SYSTEM FOR CONTROLLING A LIQUID-CRYSTAL DISPLAY SCREEN

BACKGROUND

1. Field of the Invention

This invention relates generally to a system for controlling a liquid-crystal display screen and particularly to a system for controlling a liquid-crystal display screen having a video signal source that receives a pixel synchronizing signal from an oscillator and a controller that delivers a control signal to the video signal source.

2. Related Art

When an image is generated on a liquid-crystal display screen, a pixel synchronizing signal must be generated to control the placement of pixels on the screen. For example, a synchronizing signal generator for generating an image on a screen is disclosed in U.S. Pat. No. 5,260,812, wherein a first oscillator delivers a clock signal and a second oscillator is provided for inserting line synchronizing pulses during the image return interval.

It is an object of the present invention to transmit synchronizing and control signals between a signal-generating device and a liquid-crystal display screen with the minimum of connection cables.

SUMMARY OF THE PRESENTLY PREFERRED EMBODIMENT

According to a preferred embodiment of the present invention, a signal generator for a liquid-crystal display screen comprises a video signal source connected to an oscillator in order to receive a pixel synchronizing signal therefrom, and a controller for delivering a control signal. A device for driving the liquid-crystal display screen comprises a video signal processor connected to the video signal connection and a signal generator for adjusting the screen, the device receives, via a control signal connection, a control signal produced by the generator and, via a video signal connection, video signals produced by the generator. The controller comprises a first frequency divider connected to the oscillator in order to receive the pixel synchronizing signal therefrom so that the control signal has a lower frequency than that of the pixel synchronizing signal, but is still synchronized with the pixel synchronizing signal.

The present invention is therefore based on the idea of transmitting the pixel synchronization by a control signal so that the control signal does not need to be synchronized.

In a device for driving a liquid-crystal display screen according to a preferred embodiment of the present invention, the video signal processor is connected to a local synchronizing signal generator in order to receive a pixel synchronizing signal therefrom, and this local pixel synchronizing signal generator includes a local oscillator with a phase synchronization loop of the PLL type, provided with a second divider and with a phase comparator, one comparison input of which is connected to the control signal input connection.

These and other features and advantages of the invention will be apparent upon consideration of the following detailed description of the preferred embodiments of the invention, taken in conjunction with the appended drawing.

DETAILED DESCRIPTION OF THE PRESENTLY PREFERRED EMBODIMENT

Figure 1:
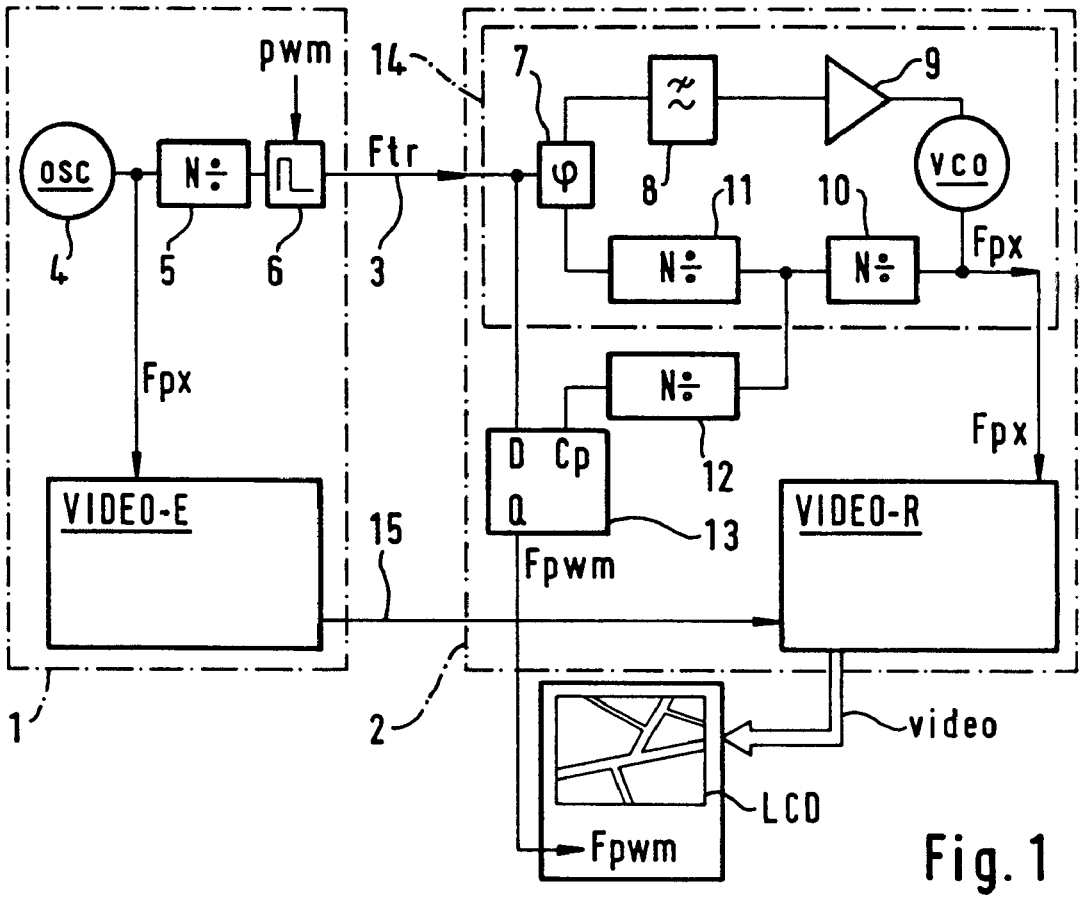
FIG. 1 is a diagram of a signal generator and a device for driving a liquid-crystal display screen according to a preferred embodiment of the present invention.

Referring to FIG. 1, a signal generator and a device for driving a liquid-crystal display screen according to a preferred embodiment of the present invention is shown. In FIG. 1, the signal generator 1 comprises a video signal source labeled VIDEO-E, connected via a video signal connection 15 to the video signal processor labeled VIDEO-R of a device 2 for driving a liquid-crystal display screen, connected to a liquid-crystal display screen, labeled LCD. The VIDEO-E source, the VIDEO-R processor and the screen LCD are well known known in the art and, therefore, are not shown in detail. The VIDEO-E source is connected to an oscillator 4 to receive a pixel synchronizing signal Fpx at the frequency fpx from the oscillator 4.

A controller delivers a control signal Ftr to a control signal connection 3. This controller comprises a first frequency divider 5 connected to the oscillator 4 to receive the pixel synchronizing signal from the oscillator 4. Thus, the control signal Ftr has a lower frequency than that of the pixel synchronizing signal, but is synchronized with it. This signal Ftr is preferably at the frequency of the video signal line. The controller further includes a pulse-width modulator 6 controlled by a pulse-width modulation (PWM) adjustable DC signal, so that the signal Ftr is a signal consisting of rectangular pulses, the pulse width of which defines the value of a quantity to be adjusted. This quantity may, for example, be the brightness of the screen. The modulator 6 is well known in the art, such as, for example, a circuit that creates a sawtooth from the square signal coming from the divider 5, and then generates a rectangular signal that has a transition every time the sawtooth crosses the "PWM" voltage threshold.

The device 2 for driving a liquid-crystal display screen delivers, to the LCD screen, video signals coming from the video signal processor VIDEO-R. This VIDEO-R processor is connected to a local synchronizing signal generator 14 to receive therefrom a pixel synchronizing signal Fpx identical to the signal Fpx from the signal generator 1. The drive device 2 further includes a signal generator for adjusting the screen, which receives the control signal Ftr produced by the generator 1.

The local pixel synchronizing signal generator includes a local "VCO" oscillator with a PLL-type phase synchronization loop provided with a second divider comprising, in succession, a first division stage 10 and a second division stage 11 which bring the pixel frequency fpx down to the frequency of the signal Ftr. A phase comparator 7 has one comparison input connected to the control signal Ftr input connection and the other comparison input is connected to the output of the division stage 11. The output is connected in a known manner to a frequency adjustment input of the "VCO" oscillator via a filter 8 and optionally an amplifier 9.

The output of the first division stage 10 is further connected to the input of a third divider 12, the output of which is connected to the clock input Cp of a D-type flip-flop, the input D of which is connected to the control signal input connection 3 and the output Q of which delivers a signal Fpwm for adjusting the screen. The D flip-flop acts as a mixer, other types of known mixers could also be suitable, but the use of a D flip-flop makes it possible to output a rectangular signal, the duty cycle of which reproduces that of the signal Ftr, but at a lower frequency.

In the preferred embodiment, the operation of the above described system is as follows: assuming that the pixel frequency fpx is 6.07 MHz, the first divider 5 has a division value of 200 so that the pulse frequency of the control signal Ftr is equal to the video signal line frequency, namely 30,350 Hz. In the drive device 2, the division stage 10 divides by two, thereby bringing the frequency to fpx/2, i.e. 3.035 MHz. The division stage 11 divides by one hundred, thereby giving a frequency of 30,350 Hz, equal to that of the signal Ftr. The divider 12 divides by 101, thereby giving a frequency of 3,035,000/101=30,049.5 Hz. Since the D flip-flop acts as a mixer, it delivers a signal whose frequency is the difference between 30,350 Hz (signal Ftr) and this 30,049.5 Hz signal. This difference is 300.5 Hz, corresponding, with sufficient accuracy, to the frequency of a signal for adjusting the brightness of the display, which is specified at 300 Hz. A division by 99 instead of 101 in the divider 12 could also be chosen, giving a similar result.

Figure 2:
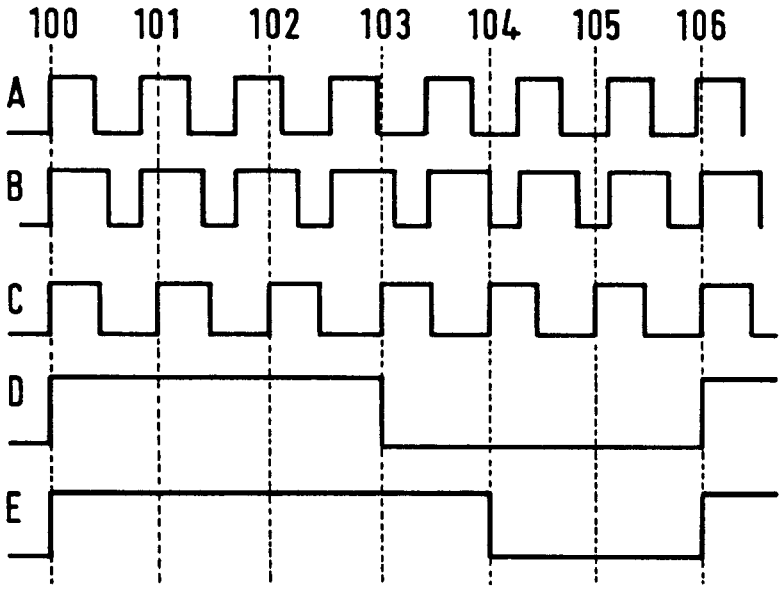
FIG. 2 is a waveform chart illustrating the operation of a device according to a preferred embodiment of the present invention.

Referring now to FIG. 2, a waveform chart illustrating the operation of a device according to a preferred embodiment of the present invention is shown. The duty cycle of the signal Fpwm reproduces that of the signal Ftr, but with a signal at a lower frequency. Line A of FIG. 2 shows the signal Ftr with a 50/50 duty cycle. Line B shows this same signal Ftr with a two thirds/one third duty cycle. Line C shows the signal coming from the divider 12, at a similar but slightly lower frequency than that of the signal of lines A and B.

If the signal A is fed into the input D of the flip-flop, the D flip-flop delivers as output, at each rising transition in the signal of line C, a signal shown by line D, which copies the instantaneous value of the signal A and maintains this value until the next transition in the signal C. Thus, for the transition marked 100, the signal D switches to one, then, for the transitions marked 101 and 102, the signal remains at one, for the transition marked 103, the signal D switches back to zero and it then remains there until the transition marked 106, when the signal D switches to one. If it is the signal B which is fed into the input D of the flip-flop, the D flip-flop delivers a signal, shown in line E, as output. Thus, for the transition marked 100, the signal D switches to one, then, for the transitions marked 101, 102, 103, the signal remains at one, for the transition marked 104, the signal D switches back to zero and then remains there until the transition marked 106, when the signal D switches to one. The signals D and E reproduce the duty cycle of the signals A and B, respectively, but at a lower frequency.

It is to be understood that a wide range of changes and modifications to the embodiments described above will be apparent to those skilled in the art and are contemplated. It is, therefore, intended that the foregoing detailed description be regarded as illustrative rather than limiting, and that it be understood that it is the following claims, including all equivalents, that are intended to define the spirit and scope of the invention.

What is claimed is:

1. A signal generator for a liquid-crystal display screen comprising an oscillator for producing a pixel synchronizing signal, a video signal source that receives a signal from the oscillator, a controller that comprises a first frequency divider that receives the pixel synchronizing signal from the oscillator, and said controller thereby outputting a control signal that has a lower frequency than the pixel synchronizing signal, but is in synchronism therewith, said arrangement furthermore having an LCD driver that comprises a local synchronizing signal generator for generating a secondary pixel synchronizing signal, and a mixer stage for generating a low-frequency control signal for said liquid crystal display screen based on mixing a subharmonic from said secondary pixel synchronizing signal and said control signal.

2. The generator as claimed in claim 1, wherein the controller comprises a pulse-width modulator so as to deliver a signal consisting of rectangular pulses (Ftr), the pulse width of which defines the value of a quantity to be adjusted.

3. The generator as claimed in claim 1, wherein the first divider has a division value such that the pulse frequency of the control signal is equal to the line frequency of the video signal.

4. A device for driving a liquid-crystal display screen, intended to receive, via a video signal connection, video signals produced by a generator, the device comprising a signal processor connected to the video signal connection, and a signal generator for adjusting the screen, intended to receive, via a control signal connection, a control signal produced by the generator, wherein the video signal processor is connected to a local synchronizing signal generator in order to receive a pixel synchronizing signal therefrom, and the local pixel synchronizing signal generator includes a pixel-frequency local oscillator with a PLL-type phase synchronization loop, provided with a second divider, which gives a frequency equal to the frequency of the control signal, and with a phase comparator, one comparison input of which is connected to the control signal input connection.

5. The device for driving a display screen as claimed in claim 4, wherein the second divider comprises, in succession, a first division stage and a second division stage and wherein the output of the first division stage is connected to the input of a third divider, the output of which is connected to one input of a mixer whose other input is connected to the control signal input connection and whose output delivers a signal for adjusting the screen.

6. The device for driving a display screen as claimed in claim 5, wherein the mixer is a D-type flip-flop, the clock input of which is connected to the output of the third divider, the input of which is connected to the control signal input connection and the output of which delivers the signal for adjusting the screen.

7. A signal generator for a liquid-crystal display screen comprising:

a video signal source;

an oscillator connected to the video signal source, wherein the video signal source receives a pixel synchronizing signal from the oscillator;

a controller for delivering a control signal, the controller comprising a first frequency divider connected to the oscillator wherein the first frequency divider receives the pixel synchronizing signal from the oscillator, and the control signal outputs a control signal that has a frequency synchronized with, and lower than, the pixel synchronizing signal; and a liquid crystal display driver comprising;

a local synchronizing signal generator for generating a secondary pixel synchronizing signal; and a mixer for generating a low-frequency control signal for the liquid crystal display screen that is a mix of a subharmonic from the secondary pixel synchronizing signal and the control signal.

8. The generator as claimed in claim 7, wherein the controller comprises a pulse-width modulator for delivering a signal consisting of rectangular pulses, wherein the pulse width of the rectangular pulses define an adjustable variable.

9. The generator as claimed in claim 7, wherein the first divider divides the pulse frequency of the control signal so that the frequency of the control signal is equal to the line frequency of the video signal.

10. A device for driving a liquid-crystal display screen that receives video signals produced by a video signal generator via a control signal input connection, the device comprising:

a video signal processor connected to the video signal generator;

an adjustment signal generator for adjusting the liquid-crystal display screen, the adjustment signal generator receiving a control signal produced by the video signal generator; and a local pixel synchronizing signal generator connected to the video signal processor, the local synchronizing signal generator receiving a pixel synchronizing signal from the video signal processor;

wherein the local pixel synchronizing signal generator comprises:

a pixel-frequency local oscillator having a PLL-type phase synchronization loop;

a second divider creating a frequency equal to the frequency of the control signal; and a phase comparator having one comparison input connected to the control signal input connection.

11. The device for driving a display screen as claimed in claim 10, wherein the second divider comprises a first division stage and a second division stage, wherein the output of the first division stage is connected to the input of a third divider, the output of the third divider is connected to one input of a mixer whose other input is connected to the control signal input connection and whose output delivers a signal for adjusting the screen.

12. The device for driving a display screen as claimed in claim 11, wherein the mixer comprises a D-type flip-flop, the clock input of the D-type flip-flop is connected to the output of the third divider, the input of the third divider is connected to the control signal input connection, and the output of the third divider delivers the signal for adjusting the screen.

* * * * *